US008920179B2

(12) United States Patent
Kuwahara et al.

(10) Patent No.: US 8,920,179 B2
(45) Date of Patent: Dec. 30, 2014

(54) CONNECTOR INCLUDING CONTACTS ARRANGED IN A MATRIX

(71) Applicant: Japan Aviation Electronics Industry, Limited, Shibuya-ku, Tokyo (JP)

(72) Inventors: Takashi Kuwahara, Tokyo (JP); Seiya Matsuo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 93 days.

(21) Appl. No.: 13/859,269

(22) Filed: Apr. 9, 2013

(65) Prior Publication Data

US 2013/0267103 A1 Oct. 10, 2013

(30) Foreign Application Priority Data

Apr. 10, 2012 (JP) ..... 2012-089448

(51) Int. Cl.

| | |
|---|---|
| ***H01R 12/00*** | (2006.01) |
| ***H01R 12/70*** | (2011.01) |
| ***H01R 12/73*** | (2011.01) |
| *H01R 12/71* | (2011.01) |

(52) U.S. Cl.

CPC ..... *H01R 12/7082* (2013.01); *H01R 12/73* (2013.01); *H01R 12/716* (2013.01)

USPC ..... 439/66

(58) Field of Classification Search

CPC ..... H01R 23/722; H01R 9/0742

USPC ..... 439/66, 67, 77, 492, 493, 495–496

See application file for complete search history.

(56) References Cited

U.S. PATENT DOCUMENTS

| | | | | | |
|---|---|---|---|---|---|
| 5,044,980 | A | * | 9/1991 | Krumme et al. | 439/496 |
| 5,228,862 | A | * | 7/1993 | Baumberger et al. | 439/66 |
| 6,010,358 | A | * | 1/2000 | Ii | 439/496 |
| 6,039,600 | A | * | 3/2000 | Etters et al. | 439/496 |
| 6,077,124 | A | * | 6/2000 | Etters et al. | 439/632 |

FOREIGN PATENT DOCUMENTS

| | | | |
|---|---|---|---|
| JP | 2002-057416 | A | 2/2002 |
| JP | 2009-038171 | A | 2/2009 |
| JP | 2011-086590 | A | 4/2011 |

* cited by examiner

*Primary Examiner* — Phuongchi T Nguyen

(74) *Attorney, Agent, or Firm* — Holtz, Holtz, Goodman & Chick PC

(57) ABSTRACT

A connector 10 comprises a base member 100 and a connection film 200 which consists of an insulator film 300 and conducive portions 400 formed thereon. Openings 130 formed in the base member 100 extend in a direction crossing the pitch direction of contacts 15. The conductive portions 400 attached to elastic support portions 120 of the base member 100 face the openings 130, respectively. Therefore, the extension length of each conductive portion 400 of the connection film 200 can be larger than the pitch of the contacts 15 so that the height of each contact 15 can be made higher.

18 Claims, 17 Drawing Sheets

CONNECTOR INCLUDING CONTACTS ARRANGED IN A MATRIX

CROSS REFERENCE TO RELATED APPLICATIONS

An applicant claims priority under 35 U.S.C. §119 of Japanese Patent Application No. JP2012-089448 filed Apr. 10, 2012.

BACKGROUND OF THE INVENTION

This invention relates to a connector which is used for connection between pads of circuit boards or for connection between an land grid array (LGA) package and a circuit board.

Connectors of the aforementioned type are disclosed in, for example, JP 2009-38171 A, JP 2002-57416 A and JP 2011-86590 A.

The connector disclosed in JP 2009-38171 A or JP 2002-57416 A is constituted by forming conductive traces on an sheet-like insulator base, followed by bending the conductive traces together with the insulator base.

However, for the connector JP 2009-38171 A, sufficient contact pressures of contacts cannot be ensured upon smaller pitches. In addition, the connector of JP 2009-38171 might not be able to be used for an object such as a circuit board if the object is curved.

The connector of JP 2002-57416 is not suitable for connection with pads arranged in a matrix form such as pads of LGA package, because of its wiring patterns.

The connector of JP 2011-86590 A is constituted by forming through-holes in an insulative elastic sheet with projections, followed by forming conductive traces to obtain contacts, wherein the conductive traces are formed by plating or the like and extend continuously on the projections and the backside projections through the through-holes, respectively.

The connector of JP 2011-86590 A has a problem in realization because its fabrication processes are complex so that its cost becomes high.

SUMMARY OF THE INVENTION

It is therefore an object of the present invention to provide a connector which can ensure sufficient contact pressures of contacts on pads of a board and so on without cost incensement.

One aspect of the present invention provides a connector including a plurality of contacts which are arranged in a matrix form that has a plurality of columns in a first horizontal direction and a plurality of rows in a second horizontal direction crossing the first horizontal direction. The connector comprises a connection film and a base member. The base member comprises a plate-like main portion and a plurality of elastic support portions held by the main portion. The elastic support portions are arranged in the matrix form. The main portion is formed with a plurality of openings which correspond to the elastic support portions, respectively. Each of the openings pierces the main portion in a vertical direction perpendicular to both the first horizontal direction and the second horizontal direction and extends in a predetermined direction crossing both the first horizontal direction and the second horizontal direction in a horizontal plane which is defined by the first horizontal direction and the second horizontal direction. Each of the elastic support portions has an upper end, a lower end and an attachment surface, wherein the upper end and the lower end are opposite ends of the elastic support portion in the vertical direction, and the attachment surface is provided between the upper end and the lower end and faces the corresponding opening. The connection film has an insulator film and a plurality of conductive portions which are formed on the insulator film and correspond to the elastic support portions, respectively. Each of the conductive portions is attached through the insulator film to the upper end, the attachment surface and the lower end of the corresponding elastic support portion and faces the corresponding opening. The elastic support portion and the conductive portion form the contact.

Another aspect of the present invention provides a fabrication method of a connector, the fabrication method comprising: applying adhesive agents onto parts of a connector intermediate; setting a comb jig to the connector intermediate; and forming a connector. The connector intermediate comprises a connection film intermediate and a base member. The base member comprises a plate-like main portion and a plurality of elastic support portions held by the main portion. The elastic support portions are arranged in a matrix form that has a plurality of columns in a first horizontal direction and a plurality of rows in a second horizontal direction. The main portion is formed with a plurality of openings which correspond to the elastic support portions, respectively. Each of the openings pierces the main portion in a vertical direction perpendicular to both the first horizontal direction and the second horizontal direction and extends in a predetermined direction crossing the first horizontal direction and the second horizontal direction in a horizontal plane which is defined by the first horizontal direction and the second horizontal direction. Each of the elastic support portions has an upper end, a lower end and an attachment surface. The upper end and the lower end are opposite ends of the elastic support portion in the vertical direction. The attachment surface is provided between the upper end and the lower end and faces the corresponding opening. The connection film intermediate comprises an insulator film and a plurality of conductive belts which are formed on the insulator film to extend in the predetermined direction. The connection film intermediate is formed with a plurality of cuts, wherein each of the cuts has an angular-C shape which has two slits extending in the predetermined direction and another slit crossing one of the conductive belts to couple the two slits, and a plurality of conductor-support portions and a plurality of conductive portions are formed by the cuts to correspond to the elastic support portions, respectively. Each of the elastic support portions has a piece portion and a fixed portion, wherein the piece portion is defined by one of the cuts, and the fixed portion continues the piece portion. The conductive portion is formed continuously on the fixed portion and on the piece portion. The fixed portion is connected to the lower end of the corresponding elastic support portion. The piece portion extends downwards of the corresponding opening. The adhesive agent is applied to the upper end of the elastic support portion. The comb jig includes a substrate and a plurality of teeth which project upwards from the substrate in the vertical direction. The teeth correspond to the openings, respectively, and are inserted into the openings, respectively, upon the setting. The piece portions of the connection film intermediate are bent by the inserted teeth, respectively, to partially project upwards beyond the inserted teeth, respectively. A connector is formed by sliding a bending jig on the teeth to bend the projecting portions of the piece portions so that the projecting portions are connected to the upper portions of the elastic support portions, respectively, by the adhesive agents, wherein the connector includes a plurality of contacts, and each of the contacts comprises the elastic support portions, the conductor-support portions and the conductive portions.

An appreciation of the objectives of the present invention and a more complete understanding of its structure may be had by studying the following description of the preferred embodiment and by referring to the accompanying drawings.

Figure 1:
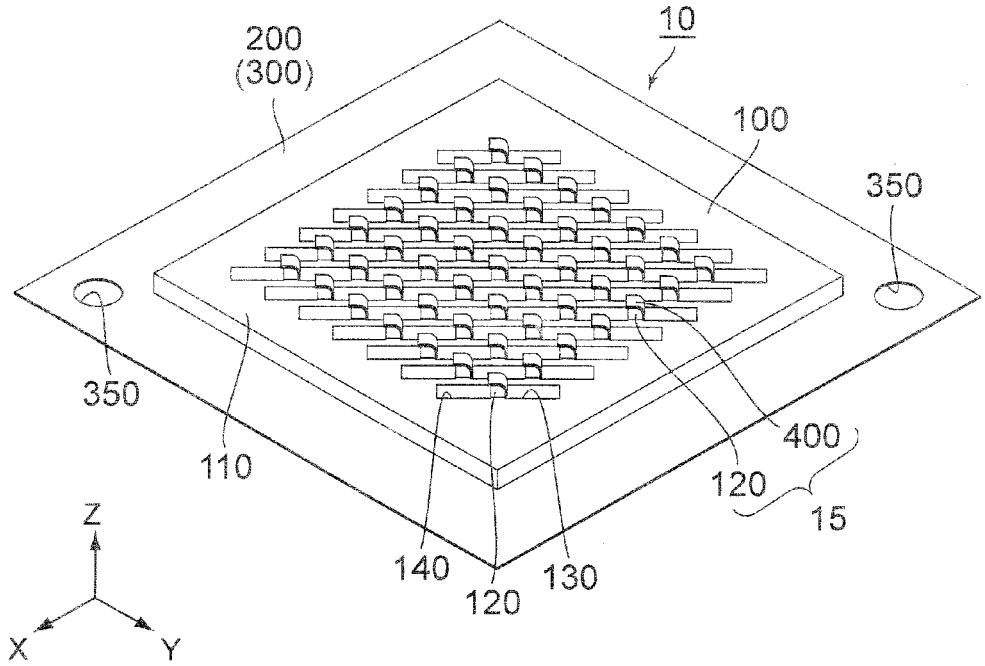
FIG. 1 is a top oblique view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
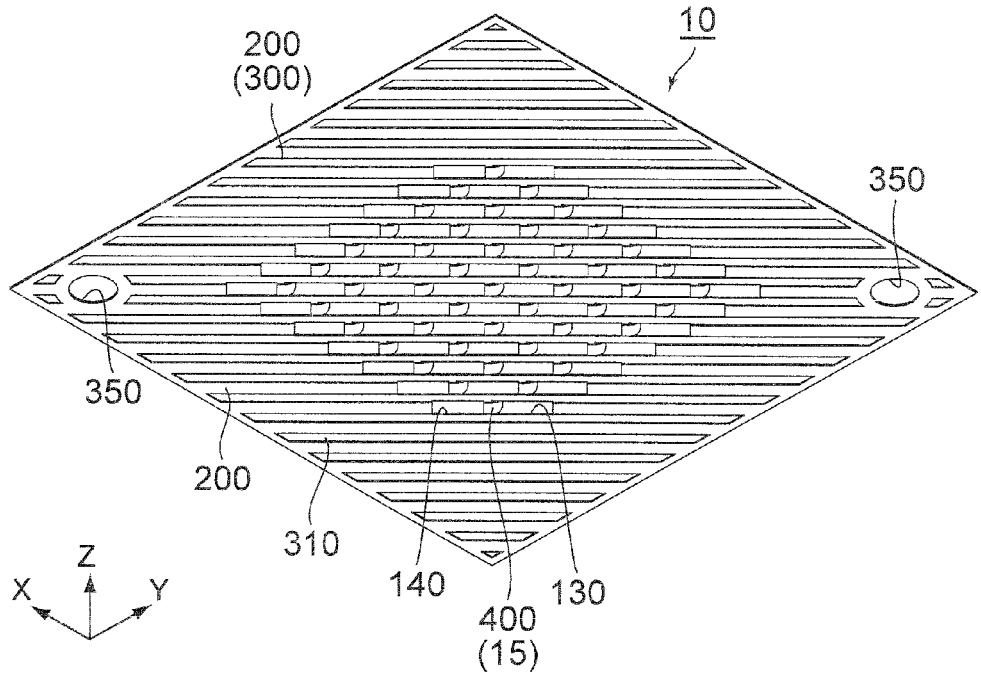
FIG. 2 is a bottom oblique view showing the connector of FIG. 1.

With reference to FIGS. 1 to 5 as well as FIGS. 19 to 23, a connector 10 according to an embodiment of the present invention is used for, for example, coupling pads of an upper (+Z side) board 950 or pads of an LGA package 1000 with pads of a lower (−Z side) board 900. The connector 10 includes a plurality of contacts 15. As best shown in FIGS. 1 and 2, the contacts 15 are arranged in a matrix form that has a plurality of columns in an X-direction (first horizontal direction) and a plurality of rows in a Y-direction (second horizontal direction). Specifically, the number of the contacts 15 according to the present embodiment is forty nine in total, and the contacts 15 are arranged in a matrix form of seven columns and seven rows.

The connector 10 illustrated in FIGS. 1 to 5 comprises a base member 100 and a connection film 200.

As shown in FIGS. 1, 3 to 5, the base member 100 comprises a main portion 110 and a plurality of elastic support portions 120 held by the main portion 110. The elastic support portions 120 form bodies or bases of the contacts 15, respectively, and are arranged in the matrix form similar to the contacts 15. The base member 100 according to the present embodiment is formed integrally of an insulator material having elasticity. However, the present invention is not limited thereto. For example, the main portion 110 and the elastic support portions 120 may be constituted by using different materials, provided that each of the elastic support portions 120 has elasticity.

As best shown in FIG. 1, the main portion 110 has a plate-like shape. Specifically, the main portion 110 of the present embodiment has a shape of a square tile.

As shown in FIGS. 1 to 5, the main portion 110 is formed with a plurality of openings 130, which correspond to the elastic support portions 120, respectively, and a plurality of back openings 140, which correspond to the elastic support portions 120, respectively. Each of the openings 130 pierces the main portion 110 in the Z-direction. Similarly, each of the back openings 140 pierces the main portion 110 in the Z-direction.

Figure 3:
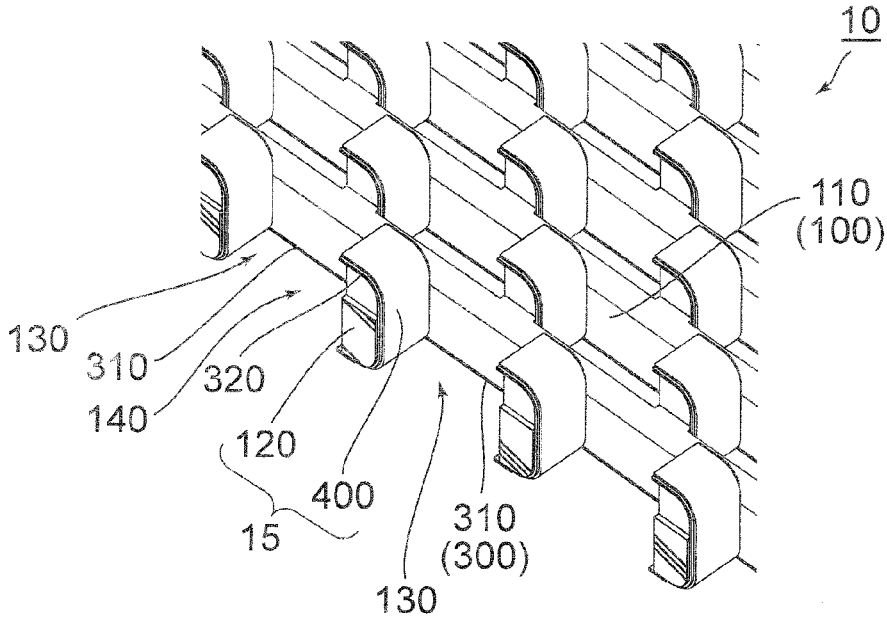
FIG. 3 is an enlarged, top oblique view showing a part of the connector of FIG. 1, wherein the connector is partially cut away.
Figure 4:
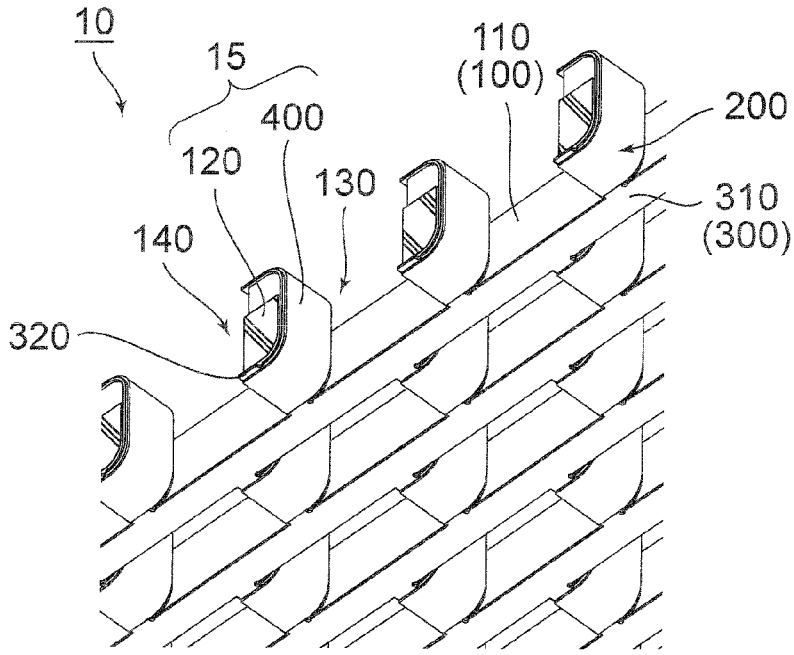
FIG. 4 is an enlarged, bottom oblique view showing a part of the connector of FIG. 1, wherein the connector is partially cut away.
Figure 5:
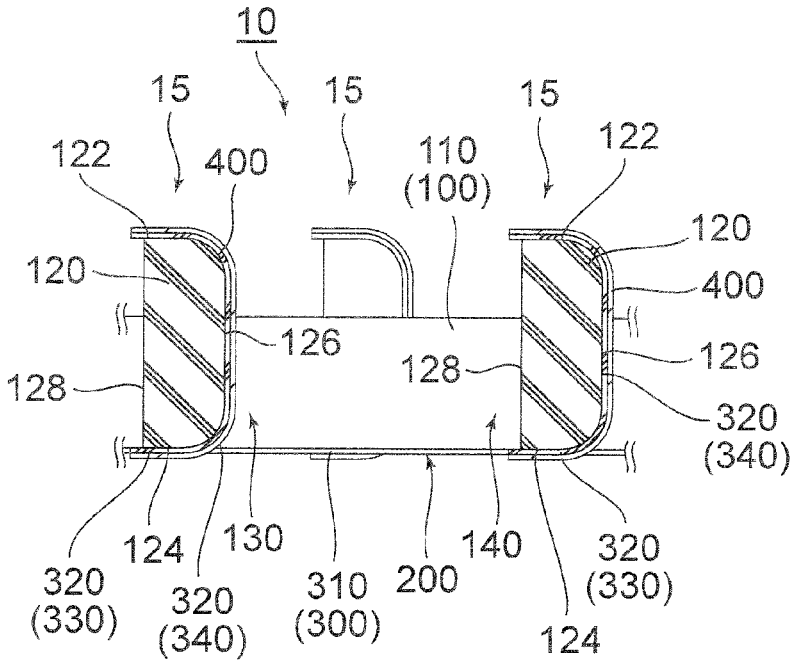
FIG. 5 is an enlarged, cross-section showing a part of the connector of FIG. 1.

As understood from FIGS. 3 to 5, if two elastic support portions 120 neighbor on each other in a predetermined direction, the opening 130 corresponding to one of the elastic support portions 120 is formed integrally with the back opening 140 corresponding the other elastic support portion 120. In other words, if two elastic support portions 120 neighbor on each other in the predetermined direction, a piercing hole existing between those elastic support portions 120 is the opening 130 for one of those elastic support portions 120 and is the back opening 140 for the other elastic support portion 120.

In yet other words, the main portion 110 of the base member 100 according to the present embodiment is formed with a plurality of long ditches, each of which extends in the predetermined direction, and in each of which one or more elastic support portions 120 are provided so as to divide the corresponding ditch in the predetermined direction. In particular, if two or more of the elastic support portions 120 are provided in one of the ditches, those elastic support portions 120 are arranged in the predetermined direction at regular intervals. Thus, each ditch is divided into two or more piercing holes (openings 130 or back openings 140).

As understood from FIGS. 1 and 2, each of the openings 130 extends in the predetermined direction crossing both the X-direction and the Y-direction in an XY plane. Therefore, a size of the opening 130 in the predetermined direction is larger than a pitch between the contacts 15 in the X-direction and the Y-direction, i.e., a pitch between the elastic support portions 120.

In addition, the predetermined direction according to the present embodiment forms an angle of 45 degrees with respect to both the X-direction and the Y-direction. Therefore, each of the openings 130 can have the largest size in the predetermined direction.

FIG. 5 is a cross-sectional view showing a part of the connector 10 in a plane that is defined by the vertical direction (Z-direction) and the predetermined direction, which forms, in this embodiment, an angle of 45 degrees with respect to both the X-direction and the Y-direction, as described above.

As best shown in FIG. 5, each elastic support portion 120 has an upper end 122, a lower end 124, an attachment surface 126 and a back surface 128 of the attachment surface 126, wherein the upper end 122 and the lower end 124 are opposite ends of the elastic support portion 120 in the Z-direction (vertical direction), and the attachment surface 126 is provided between the upper end 122 and the lower end 124.

Each of the elastic support portions 120 projects from the main portion 110 towards +Z side or upwards. Namely, the upper end 122 of the elastic support portion 120 is positioned away from the main portion 110 in the Z-direction. On the other hand, the lower end 124 of the elastic support portion 120 according to the present embodiment forms a flat surface together with the lower surface of the main portion 110. In other words, each of the contacts 15 according to the present embodiment projects, by relatively large amount, from the main portion 110 of the base member 100 in +Z side, while protruding, by the thickness of the connection film 200, from the main portion 110 of the base member 100 in −Z side. As apparent from the aforementioned structure, the connector 10 of the present embodiment can absorb size variation in the Z-direction of the board or the LGA package positioned towards +Z side so that the contacts 15 are ensured to be able to be connected to pads, respectively.

The attachment surfaces 126 face the openings 130, respectively, while the back surfaces 128 face the back openings 140, respectively. Namely, each elastic support portion 120 is positioned between the opening 130 and the back opening 140 in the predetermined direction. Each attachment surface 126 of the present embodiment, except for boundary portions described later, intersects at right angles with the predetermined direction. Also, each back surface 128 intersects at right angles with the predetermined direction.

In this embodiment, a boundary section between the upper end 122 and the attachment surface 126 of each elastic support portion 120 is curved. Also, another boundary section between the lower end 124 and the attachment surface 126 of each elastic support portion 120 is curved. In other words, each of the boundary section between the upper end 122 and the attachment surface 126 and the boundary section between the lower end 124 and the attachment surface 126 has an arc-shaped cross-section in a plane defined by the predetermined direction and the vertical direction (Z-direction). The curving of each boundary section is carried out in order to prevent stress concentration from being applied to a part of the connection film 200, e.g., conductive portion 400) upon attachment of the part of the connection film 200 to the elastic support portion 120. The boundary section may have another form, provided that it can provide similar effects. For example, each of the boundary section between the upper end 122 and the attachment surface 126 and the boundary section between the lower end 124 and the attachment surface 126 may be chamfered.

As shown in FIGS. 1 to 5, the connection film 200 comprises an insulator film 300 and a plurality of conductive portions 400 formed on the insulator film 300.

As understood from FIGS. 1 and 2, the insulator film 300 has two principal surfaces of an upper surface and a lower surface. On the upper surface of the insulator film 300, the base member 100 is provided.

As understood from FIGS. 2 to 5, the insulator film 300 has a plurality of support belt portions 310 and a plurality of conductor-support portions 320, wherein each of the support belt portions 310 extends in the predetermined direction, and each of the conductor-support portions 320 is positioned between the support belt portions 310. Among them, the support belt portions 310 are connected and fixed on the lower surface of the main portion 110 of the base member 100 and serve to prevent the conductor-support portions 320 from coming apart from each other and to keep positional relations of the conductor-support portions 320.

As apparent from FIGS. 1 to 4, each conductor-support portion 320 is positioned within a region of the insulator film 300, where the base member 100 is arranged.

As apparent from FIGS. 3 to 5, each conductor-support portion 320 consists of a fixed portion 330 and a piece portion 340, wherein the fixed portion 330 couples two support belt portions 310, and the piece portion 340 extends from the fixed portion 330 and has a tongue-like shape. The fixed portion 330 is connected and fixed only on the lower end 124 of the elastic support portion 120. On the other hand, the piece portion 340 is attached only to the elastic support portion 120. In other words, the conductor-support portion 320 is attached to the elastic support portion 120 so that the fixed portion 330 is connected to the lower end 124 of the elastic support portion 120.

The connection film 200 according to the present embodiment is connected to the lower side of the base member 100 upon molding of the base member 100. In detail, the support belt portions 310 are connected to the lower surface of the main portion 110 upon the molding of the base member 100, while the conductor-support portions 320 are connected to the lower ends 124 of the elastic support portions 120, respectively, upon the molding of the base member 100. On the other hand, ends of the piece portions 340 of the conductor-support portions 320 are connected to the upper ends 122 of the elastic support portions 120, respectively, by adhesive agents.

As shown in FIGS. 1 and 2, the insulator film 300 has a size larger than another size of the base member 100 in the XY plane. In a region of the insulator film 300, where the base member 100 is not disposed, positioning holes 350 are formed. The number of the positioning holes 350 according to the present embodiment is two. Every positioning hole 350 is positioned on a straight line obtained by elongating a diagonal line of the main portion 110 of the base member 100. As understood from FIGS. 1 and 2, the connector 100 of the present embodiment has a structure symmetrical with respect to a straight line passing through the positioning holes 350.

The contacts 15 of the present embodiment are arranged in the matrix form that its columns and its rows are same in number as each other. Namely, even if the connector 10 is rotated 180 degrees, the arrangement of the contacts 15 does not change substantially. Therefore, two positioning holes 350 are sufficient for positioning the contacts 15. However, the connector 10 may have three or more positioning holes 350. In particular, if the arrangement of the contacts 15 has columns and rows different from each other, it is preferable that the connector 10 has three or more positioning holes 350, or that, if the connector 10 has two positioning holes 350, the connector 10 has another structure asymmetrical with respect to a straight line passing through the positioning holes 350.

As shown in FIG. 5, the conductive portions 400 according to the present embodiment are formed on the conductor-support portions 320. The conductive portions 400 correspond to the conductor-support portions 320, respectively. Specifically, each of the conductive portions 400 is formed continuously on the corresponding fixed portion 330 and on the corresponding piece portion 340. The conductive portions 400 correspond to the elastic support portions 120, respectively.

The conductive portions 400 are attached to the elastic support portion 120 with the conductor-support portions 320 of the insulator film 300 interposed therebetween so as to form the contacts 15, respectively. In detail, each of the conductive portions 400 is attached through the conductor-support portion 320 to the upper end 122, the attachment surface 126 and the lower end 124 of the corresponding elastic support portion 120. Thus, the upper sides of the elastic support portions 120 and the lower sides of the elastic support portions 120 can be connected by the conductive portions 400, respectively. If each of the conductive portions 400 is supported by the elastic support portion 120 via the conductor-support portion 320, the conductive portion 400 faces the opening 130 corresponding to the elastic support portion 120.

An extension length of each conductive portion 400 is longer than a pitch between the elastic support portions 120 in the X-direction and the Y-direction, Therefore, the height of the elastic support portion 120, i.e., the height of the contact 15, can be higher. As the result, each contact 15 of the present embodiment can be brought into contact with a pad of a board or an LGA package with sufficient contact pressure.

Now, explanation will be made about a fabrication method of the connector 10 with the above-mentioned structure, with reference to further drawings.

Figure 6:
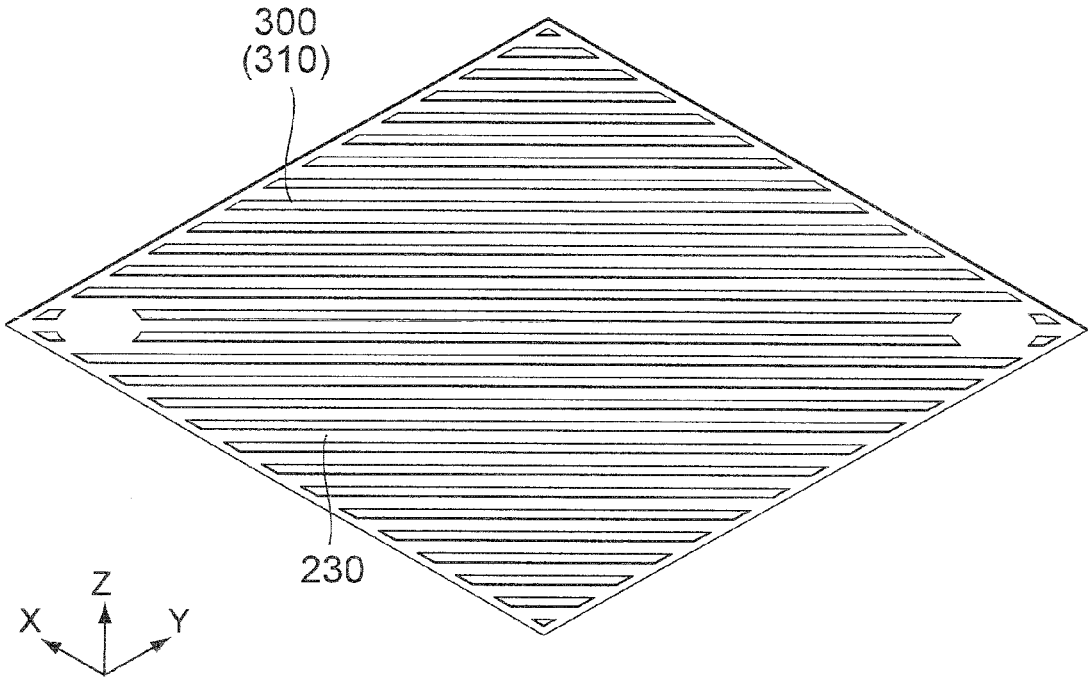
FIG. 6 is a bottom oblique view showing a process for fabricating a connection film intermediate included in the connector of FIG. 1.

First, as shown in FIG. 6, a conductive pattern including a plurality of conductive belts 230 is formed on the lower surface of the insulator film 300, i.e., one of two principal surfaces of the insulator film 300. The conductive pattern of the present embodiment is formed through photolithography or plating and has a multi-layered film (metal film) of Au/Ni/Cu. As apparent from the drawing, each conductive belt 230 extends in the predetermined direction.

Figure 7:
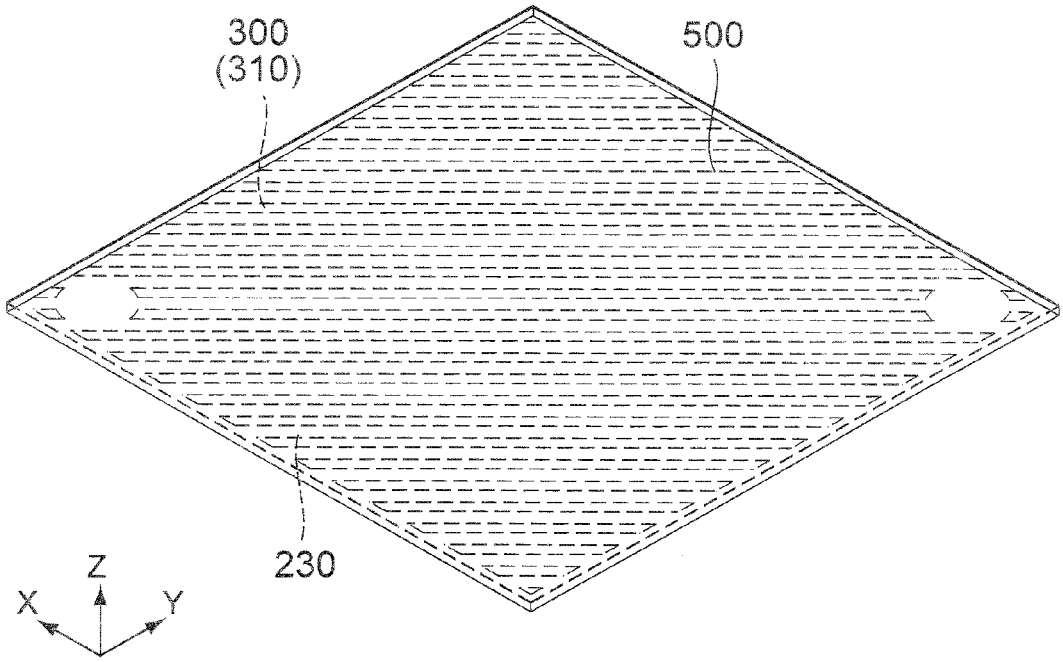
FIG. 7 is a bottom oblique view showing a process subsequent to the process of FIG. 6.

Next, as shown in FIG. 7, in order to protect the conductive belts 230, a protection member 500 is stuck on the lower surface of the insulator film 300, i.e. one of two principal surfaces of the insulator film 300 where the conductive belts 230 are formed, to cover the conductive belts 230. The protection member 500 is made of a protection tape or protection sheet, one surface of which is provided with sticky agents. The sticking of the protection member 500 makes its handling easier because its total thickness becomes thicker.

Figure 8:
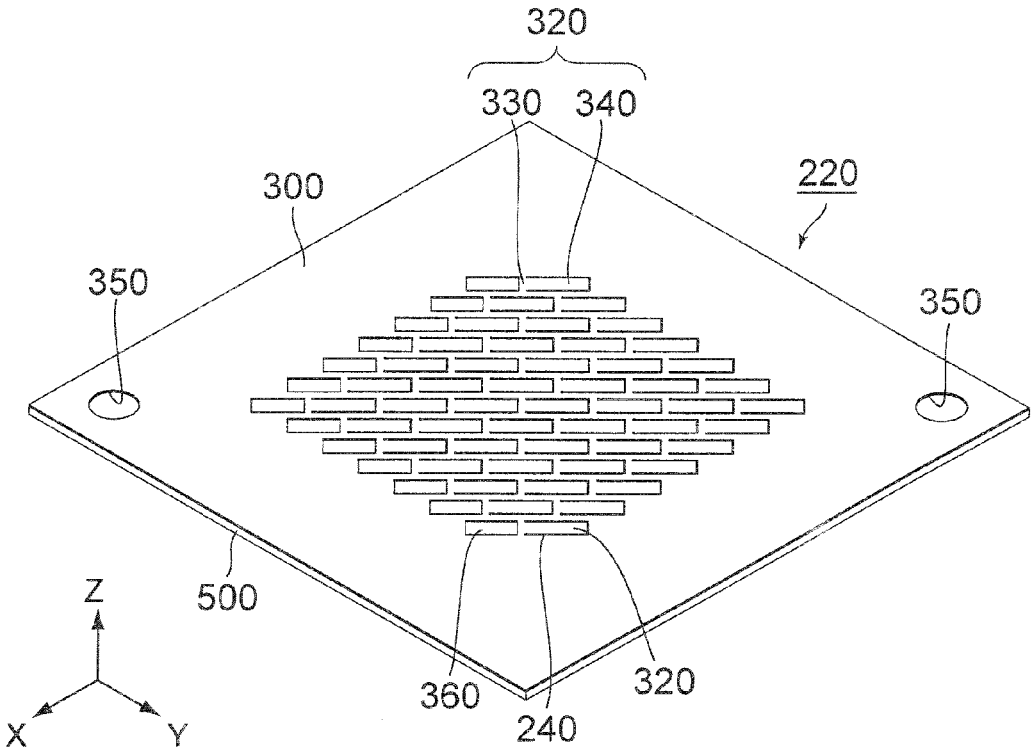
FIG. 8 is a top oblique view showing a connection film intermediate, wherein a protection member is attached to a bottom of the connection film intermediate.

Next, As shown in FIG. 8, the upper surface of the insulator film 300, i.e., the principal surface of the insulator film 300 where the conductive belts 230 are not formed, is formed with a plurality of cuts 240 and with the positioning holes 350 and angular holes 360 so that a connection film intermediate 220 is obtained. More specifically, the upper surface of the insulator film 300 is formed with the plurality of cuts 240 through a press processing or a laser processing while being formed with other cuts corresponding to the positioning holes 350 and the angular holes 360; undesirable parts within the holes are removed so that the positioning holes 350 and the angular holes 360 are formed. The cuts 240 are arranged in correspondence with the openings 130, respectively, while the angular holes 360 are arranged in correspondence with the back openings 140 which are not formed integrally with the openings 130.

Figure 9:
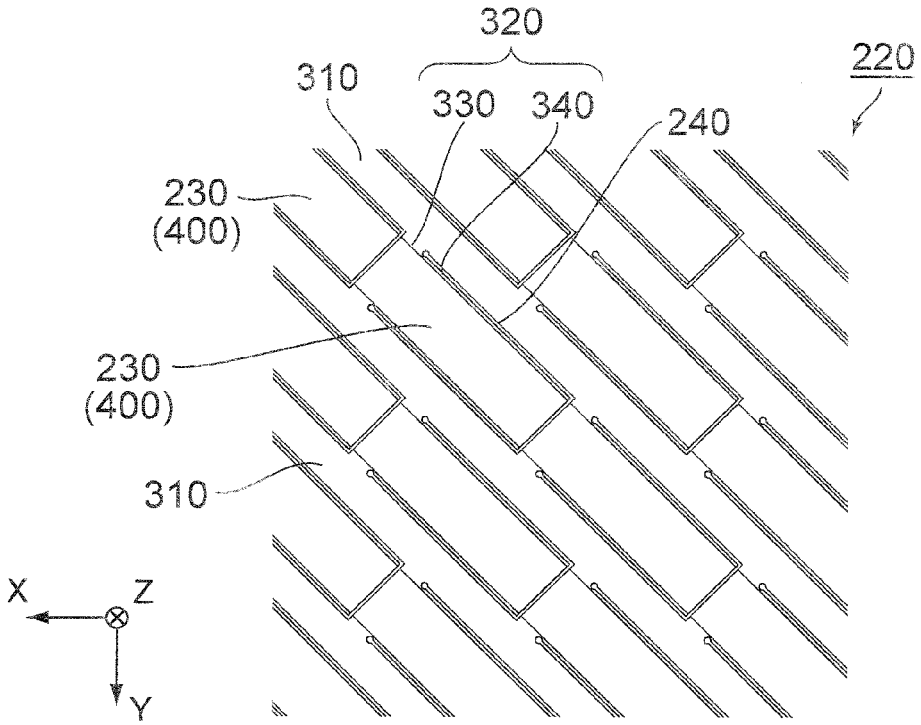
FIG. 9 is an enlarged, bottom view of a part of the connection film intermediate of FIG. 8, wherein the protection member is omitted.

In detail, as shown in FIG. 9, each of the cuts 240 has an angular-C shape. Two slits of each cut 240 extend in the predetermined direction, while the other slit crosses one of the conductive belts 230 and couples the two slits. The cuts 240 divide one of the conductive belts into two or more conductive portions 400, which correspond to the elastic support portions 120, respectively, as described above.

In addition, the cuts 240 and the other cuts for formation of the positioning holes 350 and the angular holes 360 are required to pierce the conductive belts 230 and the insulator film 300, but it is preferable that the cuts 240 and the other cuts do not pierce the protection member 500 in consideration of subsequence processes or handling of the connection film intermediate 220.

Figure 10:
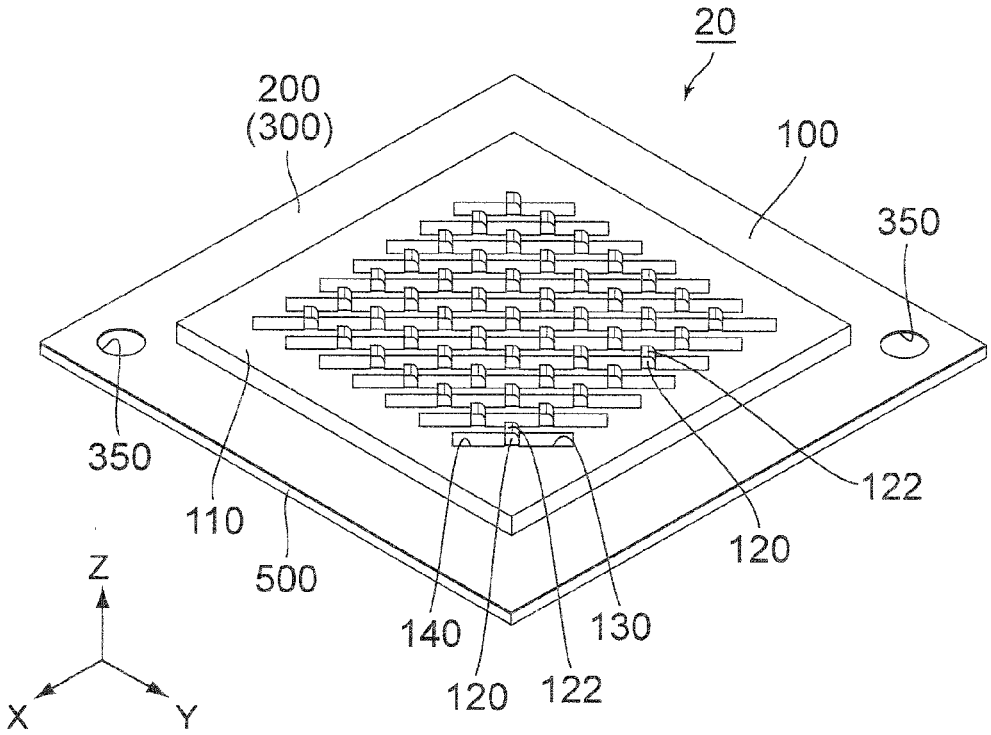
FIG. 10 is a top oblique view showing a connector intermediate, wherein the protection member is attached to a bottom of the illustrated connector intermediate, i.e., the bottom of the connection film intermediate.

Next, as shown in FIG. 10, the base member 100 is molded directly on the upper surface of the connection film intermediate 220, i.e. the surface where the conductive portions 400 are not formed, by the use of die through an injection molding process or the like, so that the connector intermediate 20 can be obtained. The direct molding of the base member 100 on the connection film intermediate 220 can connect the lower surface of the main portion 110 with the support belt portions 310 and can connect the fixed portions 330 of the conductor-support portions 320 with the lower ends 124 of the elastic support portions 120. Under this circumstances, the piece portions 340 of the conductor-support portions 320 are positioned under the openings 130 or on −Z side of the openings 130. In addition, the connection film intermediate 220 and the base member 100 may be connected with each other by other methods. However, in order to position and arrange the conductor-support portions 320, accordingly, the conductive portions 400, and the elastic support portions 120 with precision through simple measure, it is preferable that the base member 100 is molded directly on the connection film 220, as in the present embodiment.

After the connector intermediate 20 is thus obtained, adhesive agents are applied to the upper ends 122 of the elastic support portions 120. In this embodiment, the adhesive agents are of thermoset type. However, the present invention is not limited thereto. Adhesive agents of other types may be used. Adhesive agents with elasticity may be used, too.

Figure 11:
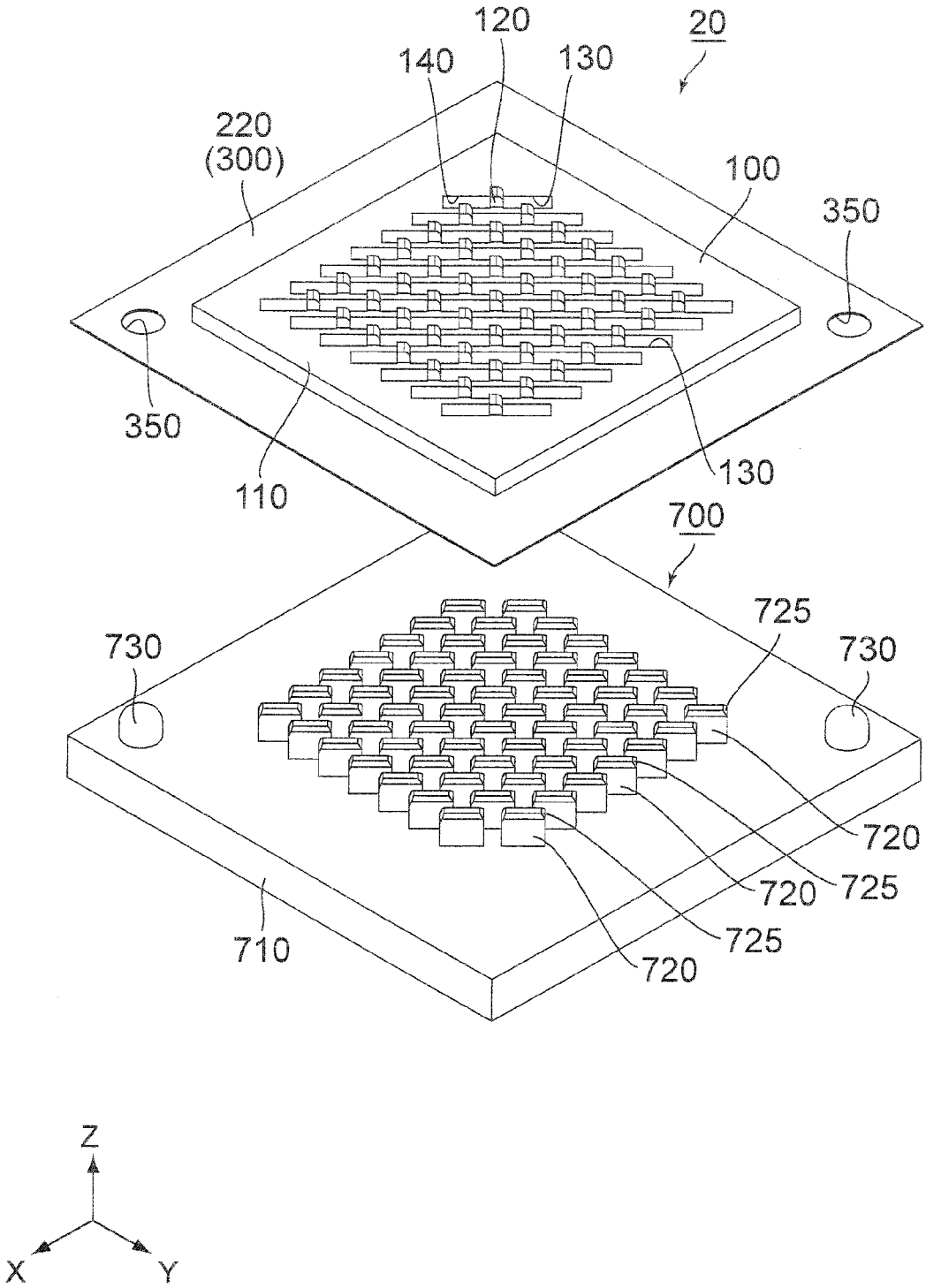
FIG. 11 is a top oblique view showing a process for fabricating a connector by using the connector intermediate of FIG. 10, wherein the protection member of FIG. 10 is removed from the connector intermediate.

Thereafter, a comb jig 700 as illustrated in FIG. 11 is set to the lower surface of the connector intermediate 20. In detail, the comb jig 700 has a square plate-shaped substrate 710, a plurality of teeth 720 and positioning projections 730, the teeth 720 and the positioning projections 730 project upwards from the substrate 710, i.e. towards +Z side from the substrate 710. The teeth 720 are arranged to correspond to the openings 130, respectively. In other words, the teeth 720 are arranged in the matrix form that has a plurality of columns in the X-direction and a plurality of rows in the Y-direction. Each tooth 720 has a rectangular cross-section which is long in the predetermined direction in the XY plane. Around the upper end of the tooth 720, beveled portions 725 are formed in order to be inserted into the opening 130 easier. The projection amount of each positioning projection 730 is smaller than the projection amount of each tooth 720. The positioning projections are provided to correspond to the positioning holes 350, respectively, and are positioned on a straight line obtained by elongating the diagonal line of the matrix of the tooth 720.

Figure 12:
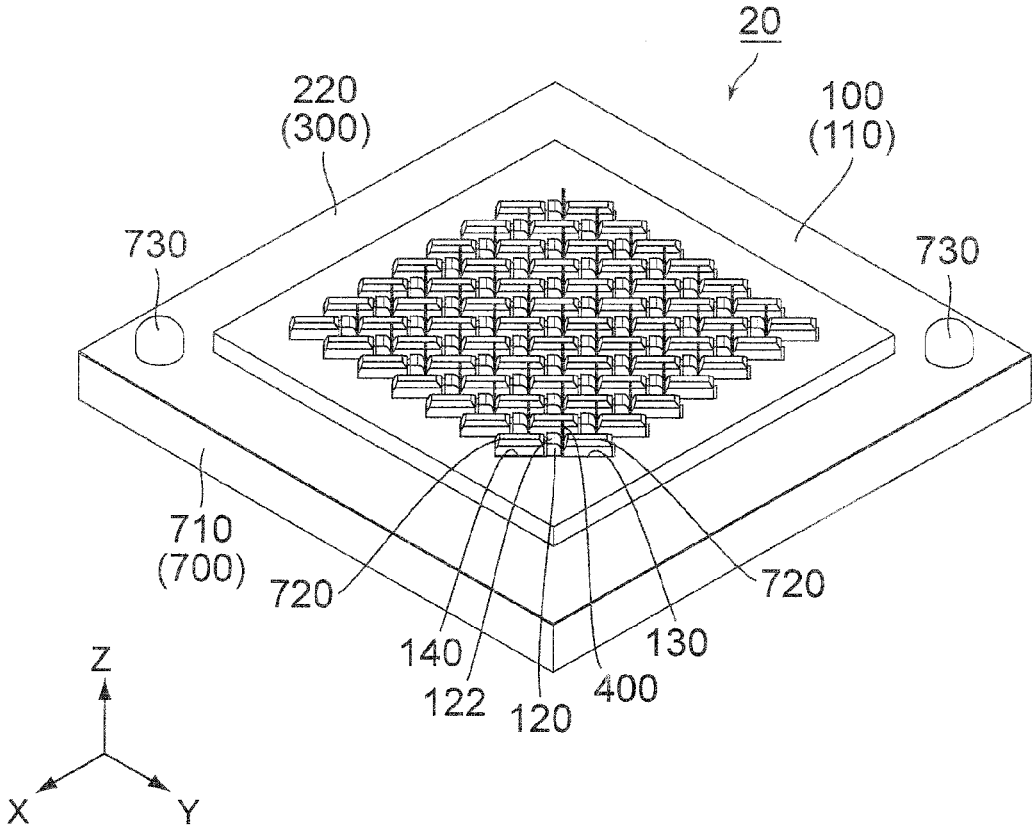
FIG. 12 is a top oblique view showing a comb jig and the connector intermediate of FIG. 11, wherein the comb jig is set to the connector intermediate.
Figure 13:
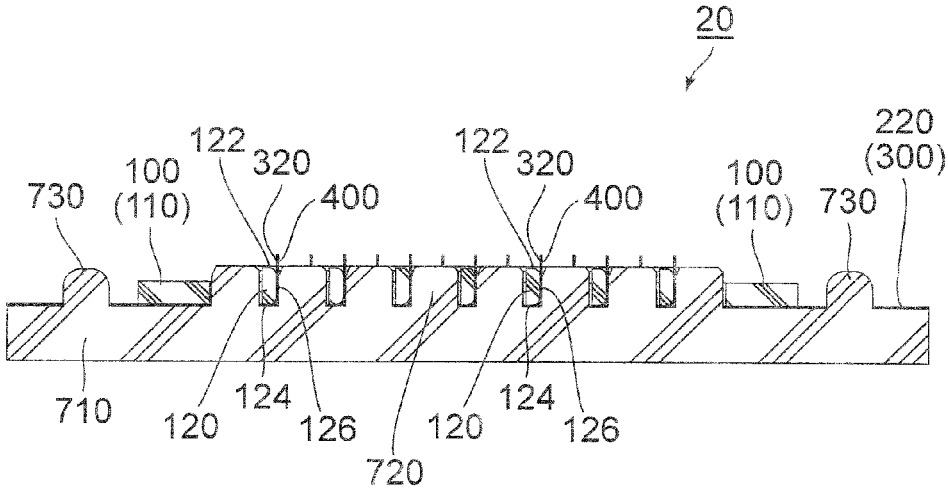
FIG. 13 is a cross-sectional view showing a condition of FIG. 12.

Next, as shown in FIGS. 12 and 13, the teeth 720 of the comb jig 700 are inserted into the openings 130, respectively, through the lower surface of the base member 100 while the positioning projections 730 are inserted into the positioning holes 350, respectively. Thus, the conductor-support portions 320, especially the piece portions 340, of the connection film intermediate 220 as well as the conductive portions 400 formed thereon are bent by the teeth 720 along the attachment surfaces 126 upwards or towards +Z side so as to partially project upwards or towards +Z side beyond the tops of the teeth 720. Thus, the lower half or −Z side of the contacts 15 are formed.

Figure 14:
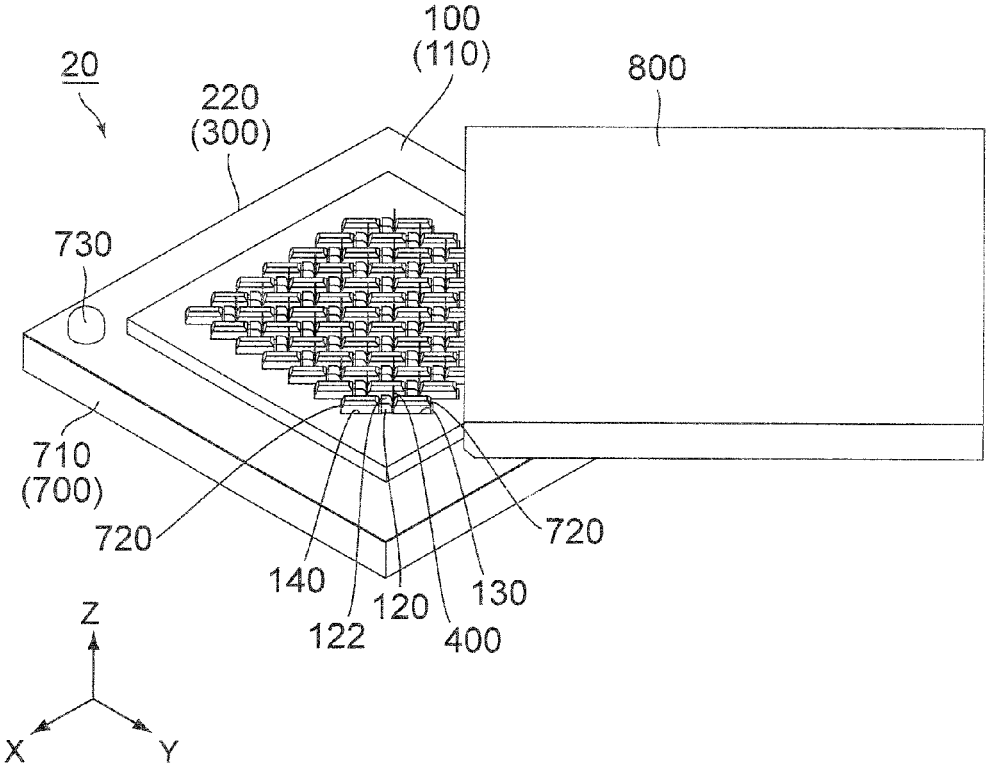
FIG. 14 is a top oblique view showing a process subsequent to the process of FIG. 12.
Figure 15:
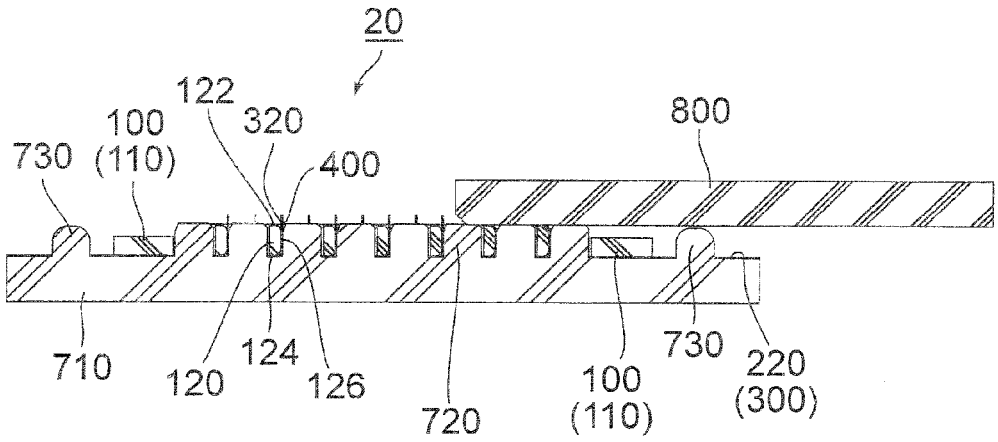
FIG. 15 is a cross-sectional view showing a condition of FIG. 14.

Next, as shown in FIGS. 14 and 15, a bending jig 800 is slid on the teeth 720 of the comb jig 700, wherein the bending jig 800 has at least flat and sufficiently wide bottom surface. Thus, the projecting parts of the piece portions 340 together with the corresponding conductive portions 400 are bent towards the elastic support portions 120 so that ends of the piece portions 340 are stuck on the upper ends 122 of the elastic support portions 120, respectively. For smooth sliding of the bending jig 800, a guide member may be used for guiding the slide of the bending jig 800.

Figure 16:
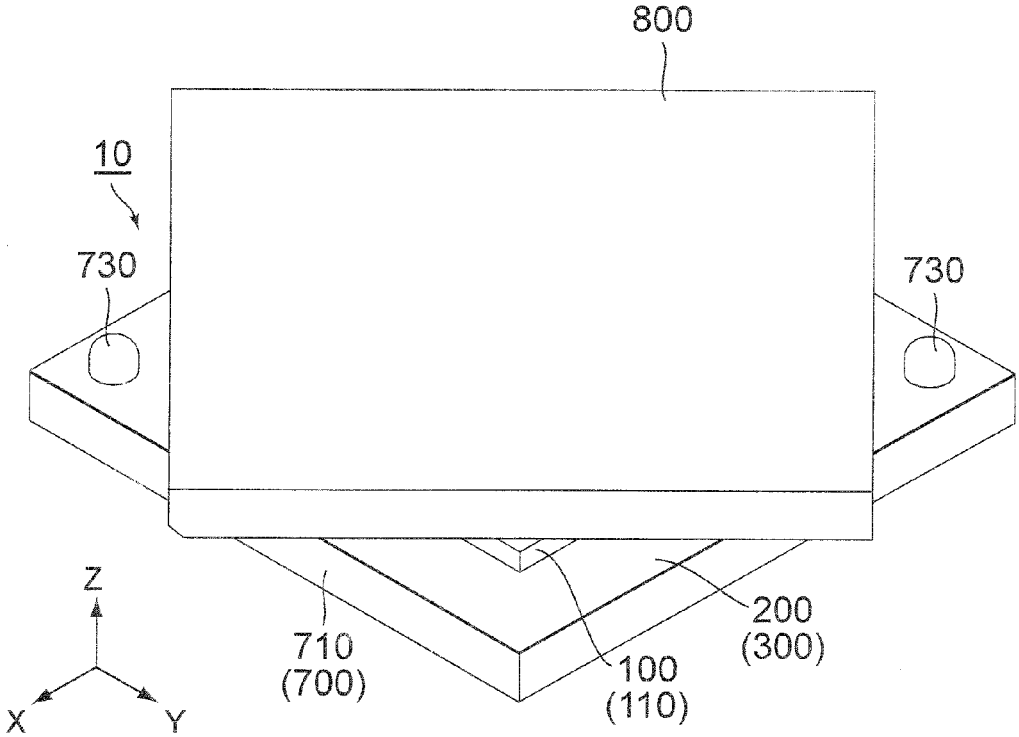
FIG. 16 is a top oblique view showing a process subsequent to the process of FIG. 14.

Furthermore, as shown in FIG. 16, the condition where the slid bending jig 800 covers all teeth 720 or the condition where the connector 10 is sandwiched between the comb jig 700 and the bending jig 800 is held to harden the adhesive agents applied to the upper ends 122 of the elastic support portions 120. Since the adhesive agents of the present embodiment are of thermoset type as described above, the adhesive agents are heated to be hardened, while the condition where the connector 10 is sandwiched between the comb jig 700 and the bending jig 800 is held by the use of clip or pin. Thereafter, the comb jig 700 and the bending jig 800 are taken off to obtain the connector 10.

Figure 17:
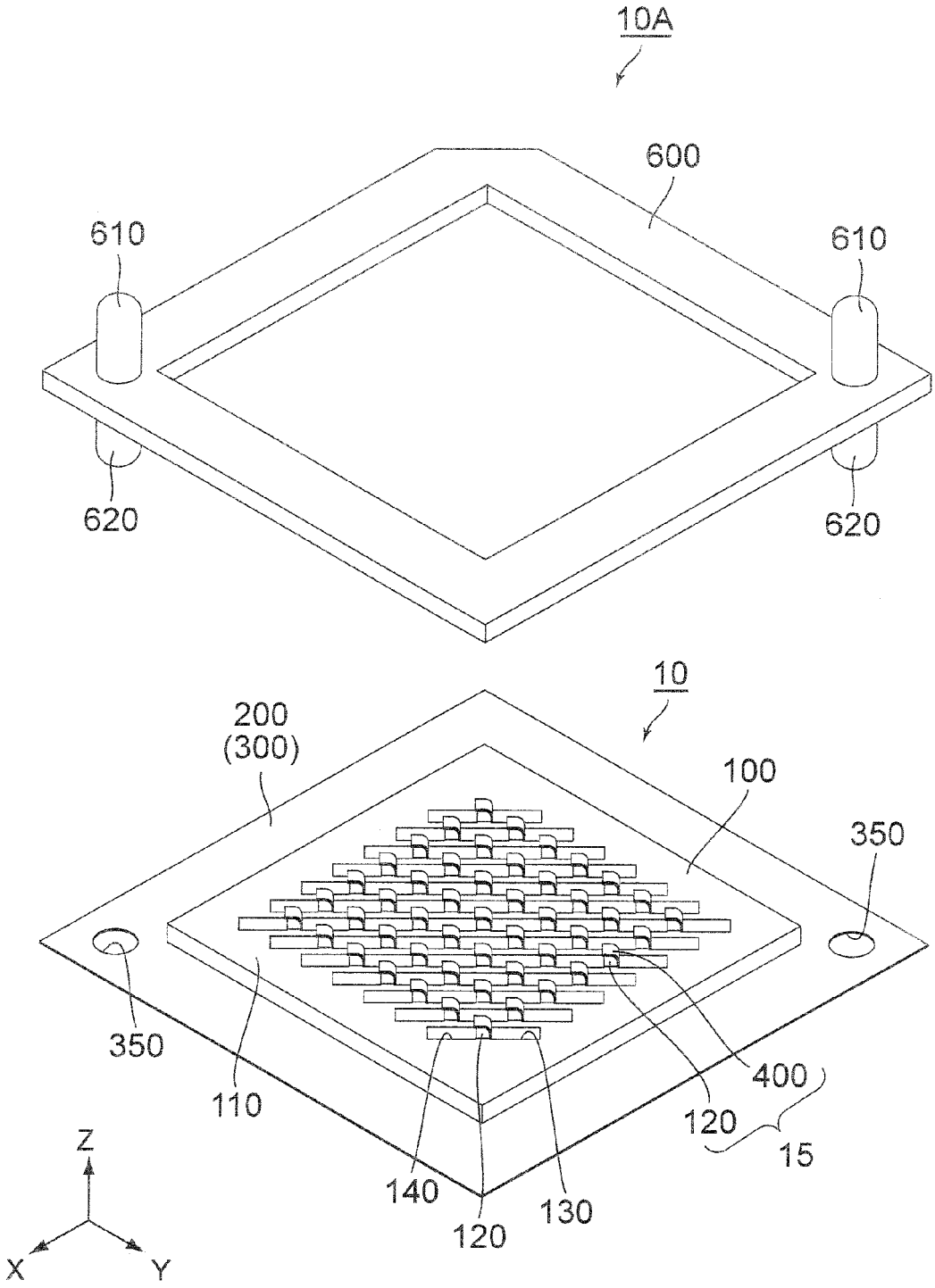
FIG. 17 is an exploded, perspective view showing a connector according to a first application.
Figure 18:
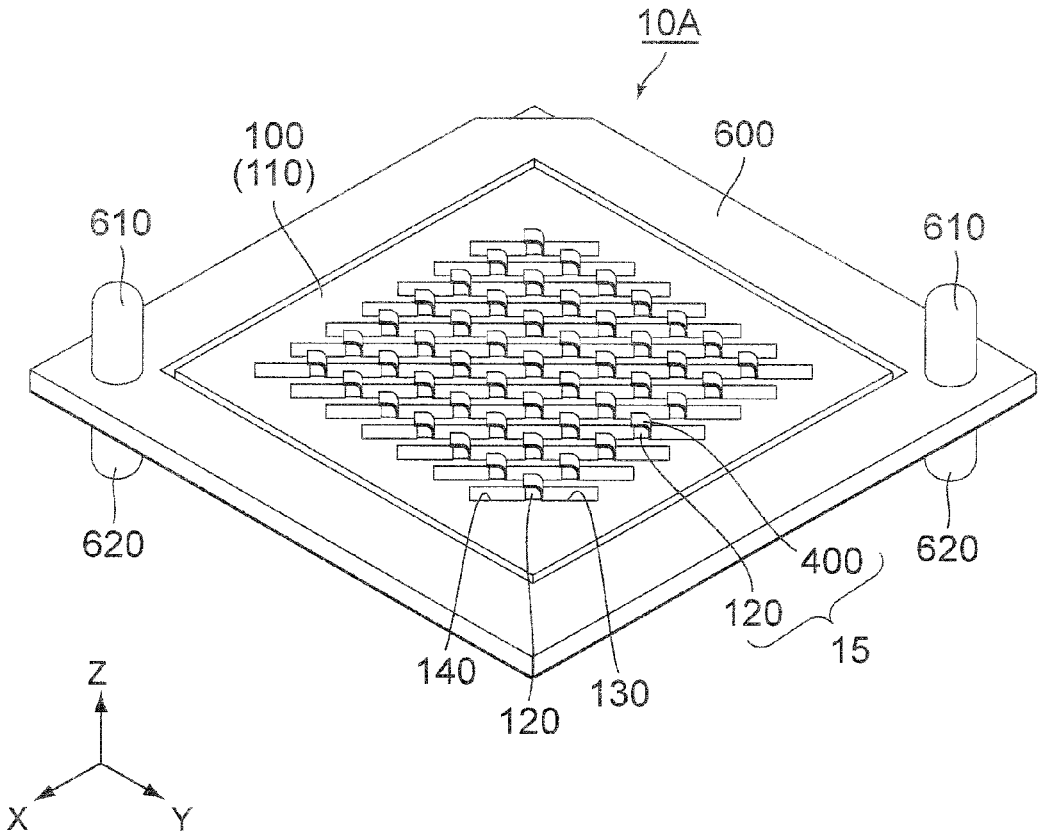
FIG. 18 is a perspective view showing the connector of FIG. 17.
Figure 19:
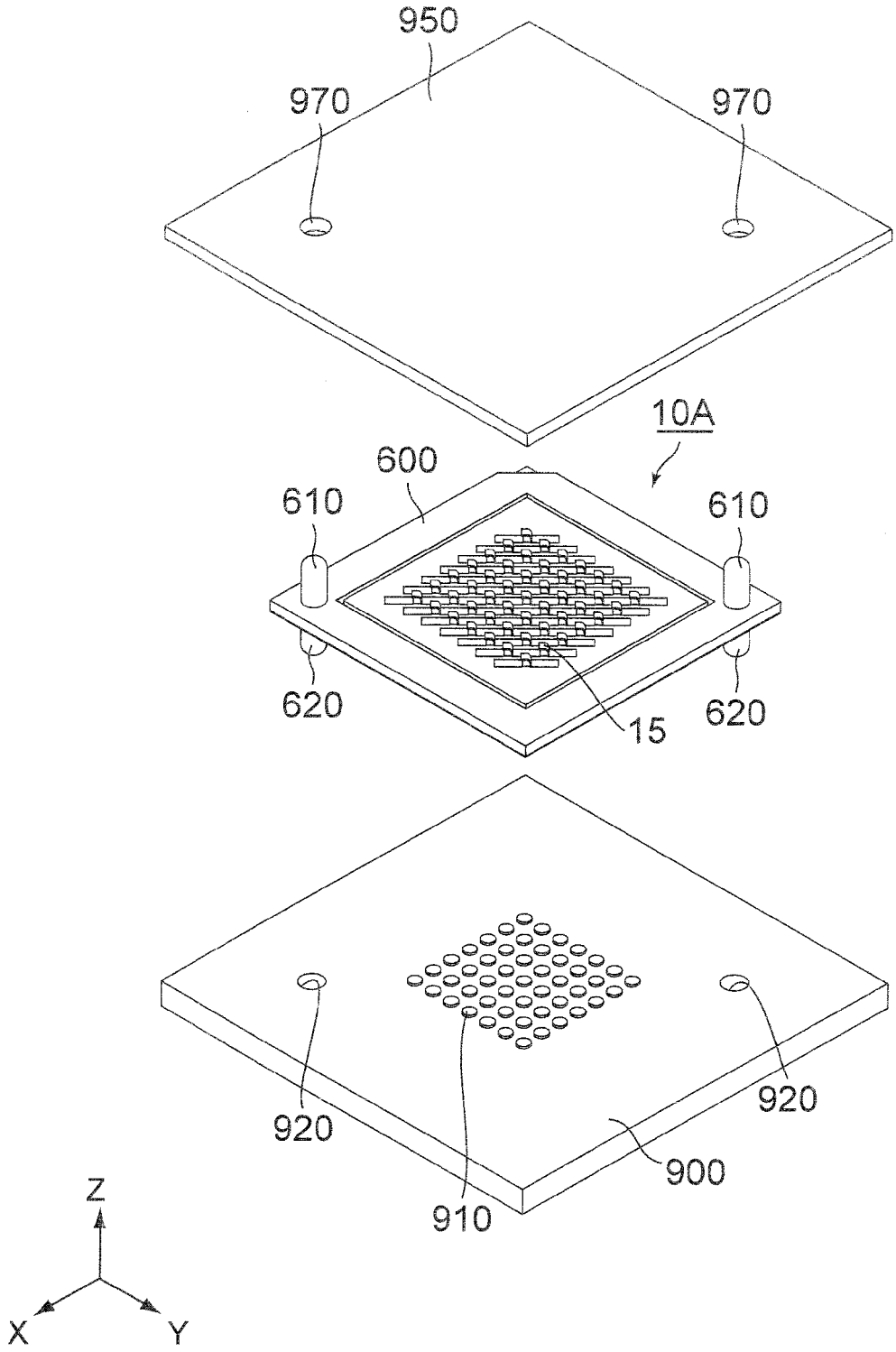
FIG. 19 is a perspective view for use in describing how to use the connector of FIG. 18.
Figure 20:
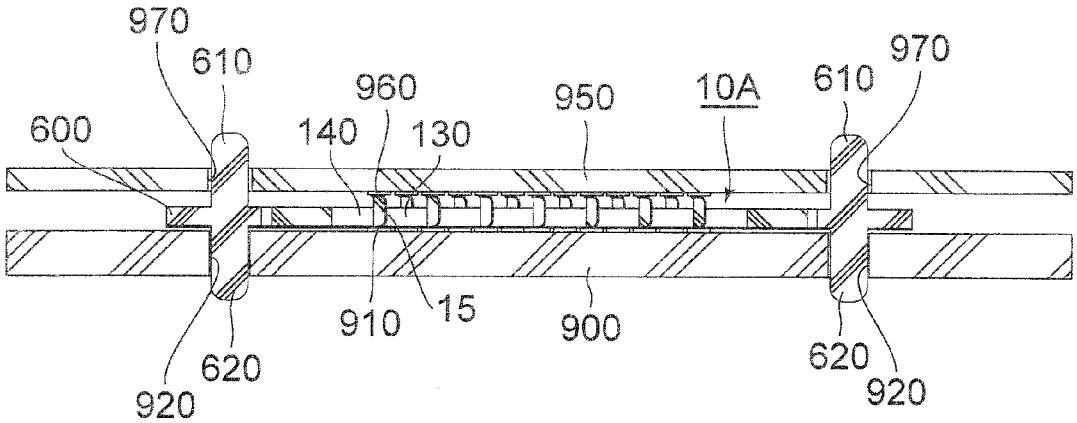
FIG. 20 is a cross-sectional view showing the connector of FIG. 19, which is sandwiched between two boards.

With reference to FIGS. 17 to 20, a connector 10A according to a first application of the above-mentioned embodiment comprises a frame 600 in addition to the connector 10 of the above-mentioned embodiment (See FIG. 1). Specifically, as shown in FIGS. 19 and 20, the connector 10A is configured to couple a board 900 and another board 950 while being interposed therebetween.

In detail, as shown in FIGS. 17 and 18, the frame 600 is disposed to surround the peripheral of the base member 100 in the XY plane. The frame 600 is provided with two positioning projections 610 and two positioning projections 620, wherein the positioning projections 610 project upwards or towards +Z side, and the positioning projections 620 project downwards or towards −Z side. The lower positioning projections 620 are inserted into the positioning holes 350 of the connection film 200, respectively, and the frame 600 is bound and fixed to the connection film 200 so as to obtain the connector 10A as shown in FIG. 18.

As shown in FIGS. 19 and 20, the lower positioning projections 620 are inserted into the positioning holes 920 of the lower board 900 so that the positioning of the contacts 15 for pads 910 formed on the lower board 900 can be carried out, while the upper positioning projections 610 are inserted into the positioning holes 970 of the upper board 950 so that the positioning of the contacts 15 for pads 960 formed on the upper board 950 can be carried out. Under the condition illustrated in FIG. 20, upward pressure is applied to the board 900 while downward pressure is applied to the board 950 so that the contacts 15 are deformed. Each of the contacts 15 can obtain sufficient contact pressure as reaction force due to the deformation so that the pads 910 and the pads 960 are electrically connected with each other by the contacts 15, respectively. Upon the connection, the illustrated connector 10A has the structure where a set of the opening 130 and the back opening 140 is assigned to each of the contacts 15, so that each contact 15 can deform at both front and back thereof in the predetermined direction. Therefore, a break of each contact 15 can be reduced in comparison with the condition where the connector has no back opening 140 so that each contact 15 can deform only within the corresponding opening 130.

Figure 21:
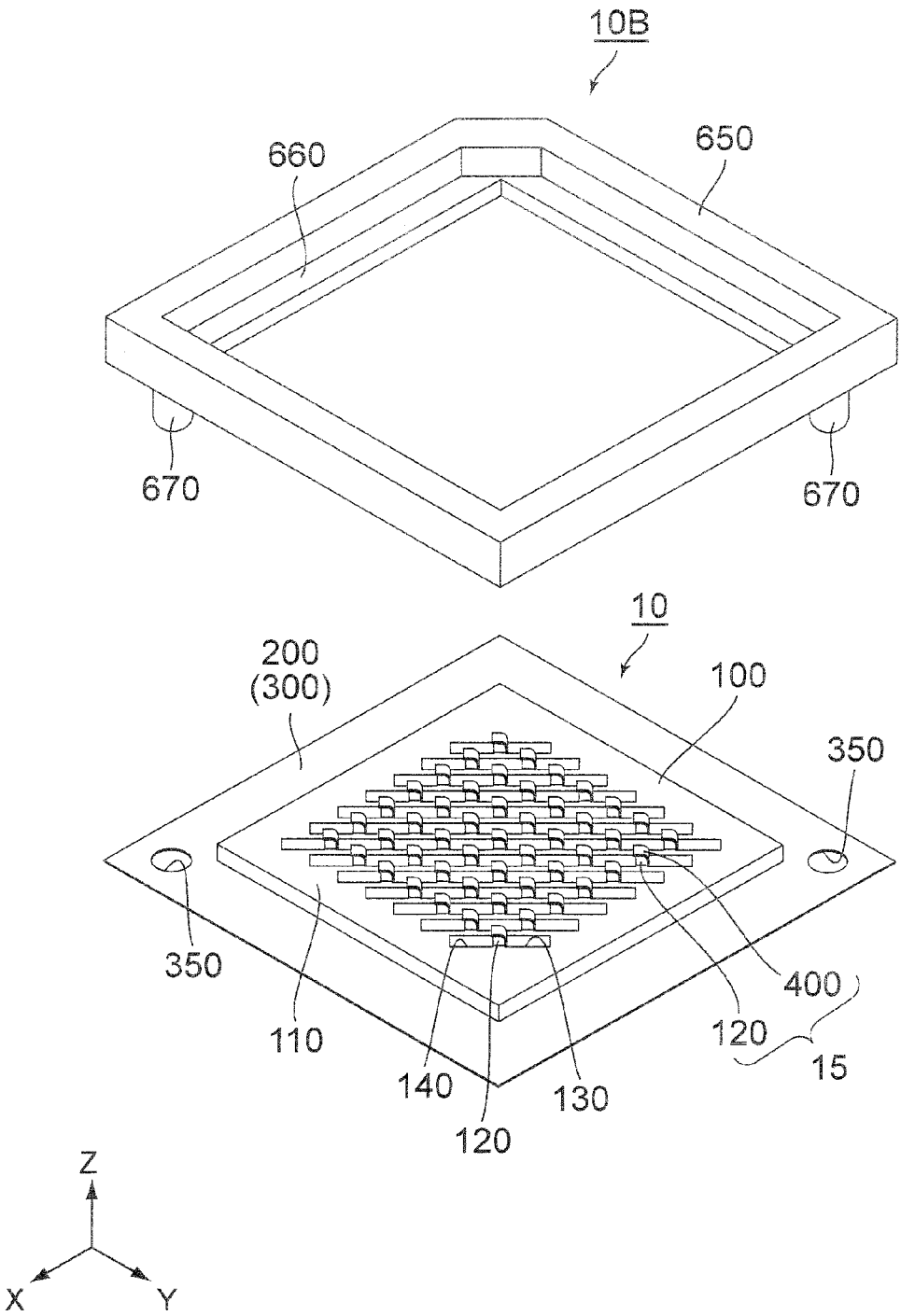
FIG. 21 is an exploded, perspective view showing a connector according to a second application.
Figure 22:
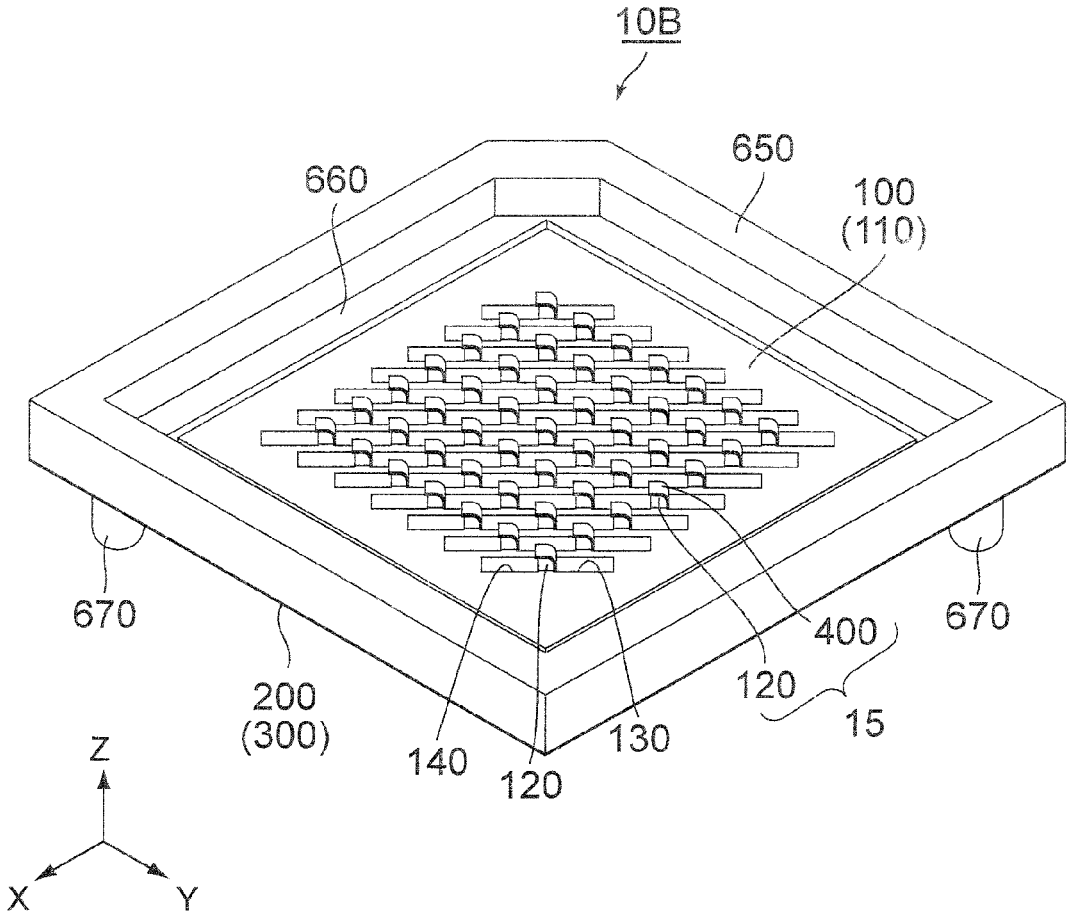
FIG. 22 is a perspective view showing the connector of FIG. 21.
Figure 23:
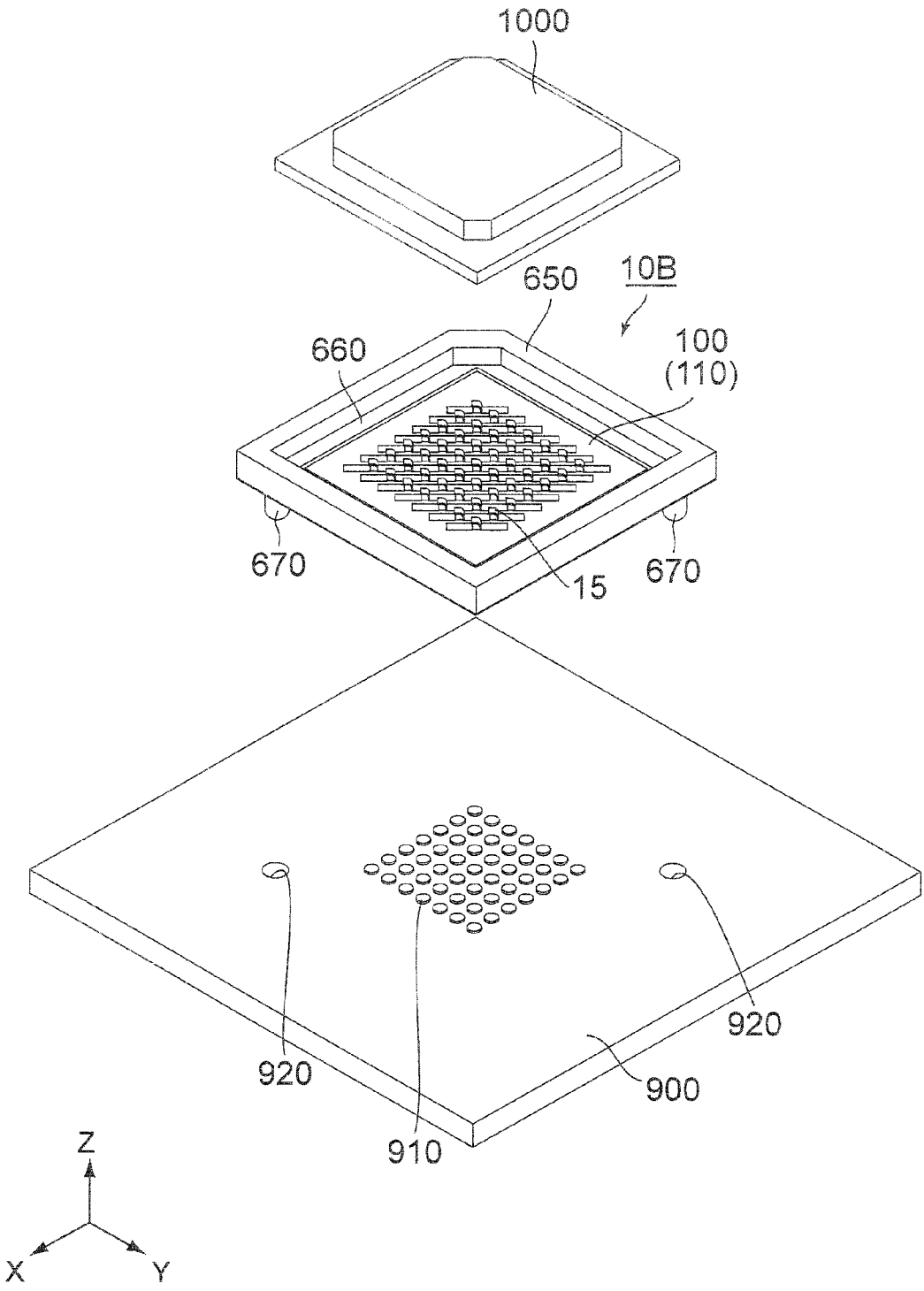
FIG. 23 is a perspective view for use in describing how to use the connector of FIG. 22
Figure 24:
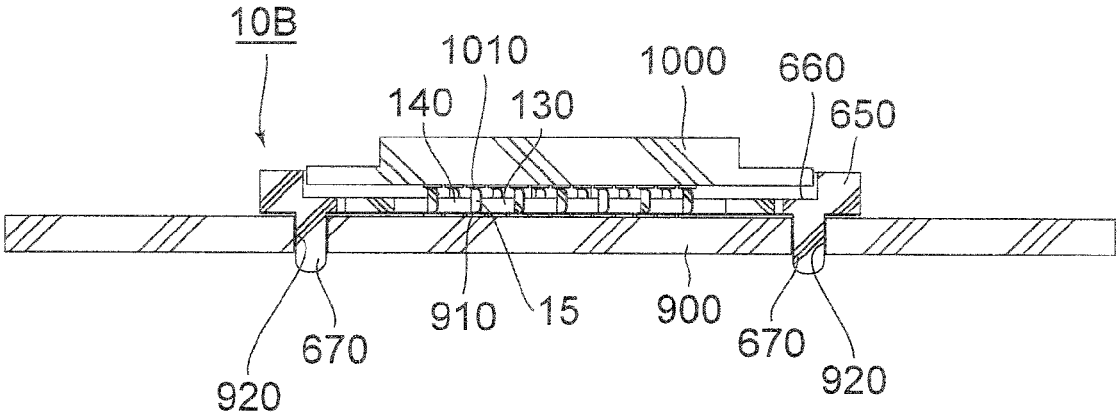
FIG. 24 is a cross-sectional view showing the connector of FIG. 23, on which an LGA package is mounted and which is mounted on a board.

With reference to FIGS. 21 to 24, a connector 10B according to a second application of the above-mentioned embodiment comprises a frame 650 in addition to the connector 10 of the above-mentioned embodiment (See FIG. 1). Specifically, as shown in FIGS. 23 and 24, the connector 10B is configured to couple a board 900 and an LGA package 100.

In detail, as shown in FIGS. 21 and 22, the frame 650 is disposed to surround the peripheral of the base member 100 in the XY plane. The frame 650 is provided with a reception portion 660 and two positioning projections 670, wherein the reception portion 660 is configured to receive the LGA package 1000, and the positioning projections 670 project downwards or towards −Z side. The positioning projections 670 are inserted into the positioning holes 350 of the connection film 200, and the frame 650 is bound and fixed to the connection film 200 so as to obtain the connector 10B as shown in FIG. 22.

As apparent from FIG. 23, the positioning projections 670 of the thus-formed connector 10B are inserted into positioning holes 920 of the board 900 so that the positioning of the contacts 15 for pads 910 formed on the board 900 can be carried out, and the connector 10B is mounted on the board 900.

Next, as shown in FIG. 24, the LGA package 100 is received within the reception portion 660 so that the positioning of the contacts 15 for pads 1010 of the LGA package 1000 can be carried out, too. Under this condition, upward pressure is applied to the board 900 while downward pressure is applied to the LGA package 1000 so that the contacts 15 are deformed. Each of the contacts 15 can obtain sufficient contact pressure as reaction force due to the deformation so that the pads 910 and the pads 1010 are electrically connected with each other by the contacts 15, respectively.

The present application is based on a Japanese patent application of JP2012-089448 filed before the Japan Patent Office on Apr. 10, 2012, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector including a plurality of contacts which are arranged in a matrix form that has a plurality of columns in a first horizontal direction and a plurality of rows in a second horizontal direction crossing the first horizontal direction: wherein:

the connector comprises a connection film and a base member;

the base member comprises a plate-like main portion and a plurality of elastic support portions held by the main portion;

the elastic support portions are arranged in the matrix form;

the main portion is formed with a plurality of openings which correspond to the elastic support portions, respectively;

each of the openings pierces the main portion in a vertical direction perpendicular to both the first horizontal direction and the second horizontal direction and extends in a predetermined direction crossing both the first horizontal direction and the second horizontal direction in a horizontal plane which is defined by the first horizontal direction and the second horizontal direction;

each of the elastic support portions has an upper end, a lower end and an attachment surface, the upper end and the lower end being opposite ends of the elastic support portion in the vertical direction, the attachment surface being provided between the upper end and the lower end and facing the corresponding opening;

the connection film has an insulator film and a plurality of conductive portions which are formed on the insulator film and correspond to the elastic support portions, respectively;

each of the conductive portions is attached through the insulator film to the upper end, the attachment surface and the lower end of the corresponding elastic support portion and faces the corresponding opening; and the elastic support portion and the conductive portion form the contact.

2. The connector as recited in claim 1, wherein an expansion length of the conductive portion is longer than a pitch between the elastic support portions in the first horizontal direction and the second horizontal direction.

3. The connector as recited in claim 1, wherein a size of the opening in the predetermined direction is larger than a pitch between the elastic support portions in the first horizontal direction and the second horizontal direction.

4. The connector as recited in claim 1, wherein:

the insulator film has a plurality of support belt portions and a plurality of conductor-support portions, each of the support belt portions extending in the predetermined direction, each of the conductor-support portions being provided between the support belt portions;

the conductor-support portion has a fixed portion and a piece portion, the fixed portion coupling between two of the support belt portions, the piece portion extending from the fixed portion;

the conductive portion is formed continuously on the fixed portion and on the piece portion;

the conductor-support portion is attached to the elastic support portion; and the fixed portion is connected to the lower end of the elastic support portion.

5. The connector as recited in claim 1, wherein a boundary section between the lower end and the attachment surface of the elastic support portion is chamfered or curved.

6. The connector as recited in claim 1, wherein a boundary section between the upper end and the attachment surface of the elastic support portion is chamfered or curved.

7. The connector as recited in claim 1, wherein:

each of the elastic support portions projects upwards from the main portion; and the upper end of each elastic support portion is located away from the main portion in the vertical direction.

8. The connector as recited in claim 1, wherein:

the first horizontal direction and the second horizontal direction are perpendicular to each other; and the predetermined direction forms an angle of 45 degrees with respect to both the first horizontal direction and the second horizontal direction.

9. The connector as recited in claim 1, wherein the connection film is connected to at least the lower ends of the elastic support portions upon molding of the base member.

10. The connector as recited in claim 1, wherein:

each of the elastic support portions has a back surface of the attachment surface;

the main portion is formed with back openings corresponding to the elastic support portions, respectively; and the back surfaces of the elastic support portions face the back openings, respectively.

11. The connector as recited in claim 10, wherein the back opening facing the back surface of one of the elastic support portions is formed integrally with the opening corresponding to another one of the elastic support portions.

12. The connector as recited in claim 1, wherein the connection film is connected to the upper ends of the elastic support portions by using adhesive agents.

13. The connector as recited in claim 12, wherein the adhesive agents has elasticity.

14. The connector as recited in claim 1, the connector further comprising a frame arranged to surround an outer peripheral of the base member in the horizontal plane.

15. The connector as recited in claim 14, wherein:

the insulator film has a size larger than another size of the base member in the horizontal plane;

the insulator film has a predetermined region where the base member is not mounted;

the predetermined region is formed with positioning holes; and the frame is formed with positioning projections to be inserted into the positioning holes, respectively.

16. A fabrication method of a connector, the fabrication method comprising:

applying adhesive agents onto parts of a connector intermediate, the connector intermediate comprising a connection film intermediate and a base member, the base member comprising a plate-like main portion and a plurality of elastic support portions held by the main portion, the elastic support portions being arranged in a matrix form that has a plurality of columns in a first horizontal direction and a plurality of rows in a second horizontal direction, the main portion being formed with a plurality of openings which correspond to the elastic support portions, respectively, each of the openings piercing the main portion in a vertical direction perpendicular to both the first horizontal direction and the second horizontal direction and extending in a predetermined direction crossing the first horizontal direction and the second horizontal direction in a horizontal plane which is defined by the first horizontal direction and the second horizontal direction, each of the elastic support portions having an upper end, a lower end and an attachment surface, the upper end and the lower end being opposite ends of the elastic support portion in the vertical direction, the attachment surface being provided between the upper end and the lower end and facing the corresponding opening, the connection film intermediate comprising an insulator film and a plurality of conductive belts which are formed on the insulator film to extend in the predetermined direction, the connection film intermediate being formed with a plurality of cuts, each of the cuts having an angular-C shape which has two slits extending in the predetermined direction and another slit crossing one of the conductive belts to couple the two slits, a plurality of conductor-support portions and a plurality of conductive portions being formed by the cuts to correspond to the elastic support portions, respectively, each of the elastic support portions having a piece portion and a fixed portion, the piece portion being defined by one of the cuts, the fixed portion continuing the piece portion, the conductive portion being formed continuously on the fixed portion and on the piece portion, the fixed portion being connected to the lower end of the corresponding elastic support portion, the piece portion extending downwards of the corresponding opening, the adhesive agent being applied to the upper end of the elastic support portion;

setting a comb jig to the connector intermediate, the comb jig including a substrate and a plurality of teeth which project upwards from the substrate in the vertical direction, the teeth corresponding to the openings, respectively, and being inserted into the openings, respectively, upon the setting, the piece portions of the connection film intermediate being bent by the inserted teeth, respectively, to partially project upwards beyond the inserted teeth, respectively; and forming a connector by sliding a bending jig on the teeth to bend the projecting portions of the piece portions so that the projecting portions are connected to the upper portions of the elastic support portions, respectively, by the adhesive agents, the connector including a plurality of contacts, each of the contacts comprising the elastic support portions, the conductor-support portions and the conductive portions.

17. A fabrication method of the connector intermediate as recited in claim 16, the fabrication method comprising: forming a connection film intermediate; and directly molding the base member on a specific surface of the insulator film to connect the fixed portions of the conductor-support portions with the lower ends of the elastic support portions, the specific surface of the insulator film being a back surface of a surface where the conductive portions are formed.

18. The fabrication method as recited in claim 17, wherein the forming of the connection film intermediate comprises:

forming the plurality of conductive belts on the insulator film;

sticking a protection member on the insulator film with the conductive belts interposed therebetween to protect the conductive belts; and making the cuts into the insulator film and the conductive belts through the specific surface.

* * * * *